US008777515B1

(12) United States Patent
Donlin

(10) Patent No.: US 8,777,515 B1
(45) Date of Patent: Jul. 15, 2014

(54) ADAPTABLE MODULAR SUBSOIL DRAINAGE SYSTEM

(76) Inventor: James M. Donlin, South Windsor, CT (US)

( * ) Notice: Subject to any disclaimer, the term of this patent is extended or adjusted under 35 U.S.C. 154(b) by 179 days.

(21) Appl. No.: 13/351,526

(22) Filed: Jan. 17, 2012

Related U.S. Application Data

(63) Continuation-in-part of application No. 11/363,668, filed on Feb. 28, 2006, now Pat. No. 8,104,994.

(60) Provisional application No. 60/657,308, filed on Feb. 28, 2005, provisional application No. 60/741,502, filed on Dec. 1, 2005.

(51) Int. Cl.
*E02B 11/00* (2006.01)

(52) U.S. Cl.
USPC ..... 405/45; 405/43; 405/36

(58) Field of Classification Search
USPC ..... 405/36–51; 210/170.03, 170.08, 747
See application file for complete search history.

(56) References Cited

U.S. PATENT DOCUMENTS

| | | | | |
|---|---|---|---|---|
| 2,052,020 | A * | 8/1936 | Black | 405/39 |
| 4,428,841 | A | 1/1984 | Favret, Jr. | |
| 4,824,287 | A | 4/1989 | Tracy | |
| 4,880,333 | A | 11/1989 | Glasser et al. | |
| 5,017,042 | A * | 5/1991 | Minor et al. | 405/50 |
| 6,048,131 | A * | 4/2000 | Laak | 405/43 |
| 6,485,647 | B1 | 11/2002 | Potts | |
| 6,726,401 | B1 | 4/2004 | Potts | |
| 6,887,383 | B2 | 5/2005 | Potts | |
| 6,923,905 | B2 | 8/2005 | Potts | |
| 7,465,390 | B2 | 12/2008 | Potts | |
| 7,614,822 | B1 | 11/2009 | Burritt et al. | |
| 2006/0182497 | A1 | 8/2006 | Potts | |
| 2006/0272988 | A1 | 12/2006 | Potts | |
| 2008/0202999 | A1 | 8/2008 | Potts | |
| 2008/0203002 | A1 | 8/2008 | Potts | |

FOREIGN PATENT DOCUMENTS

| | | | |
|---|---|---|---|
| DE | 3815443 | A1 | 9/1988 |
| JP | 60059218 | A | 4/1985 |
| RU | 1772313 | A1 | 10/1992 |

* cited by examiner

*Primary Examiner* — Sunil Singh
(74) *Attorney, Agent, or Firm* — Alix, Yale & Ristas, LLP

(57) ABSTRACT

Disclosed is a subsoil absorption system comprising a drainage unit with a support pipe extending through the inner cavities of modules which are spaced apart along the support pipe. The drainage unit is positioned within an excavation and a fluid source provides fluid to the inner cavity of at least one module which is thereafter allowed to flow from the inner cavity into excavation backfill.

20 Claims, 10 Drawing Sheets

Fig. 6A
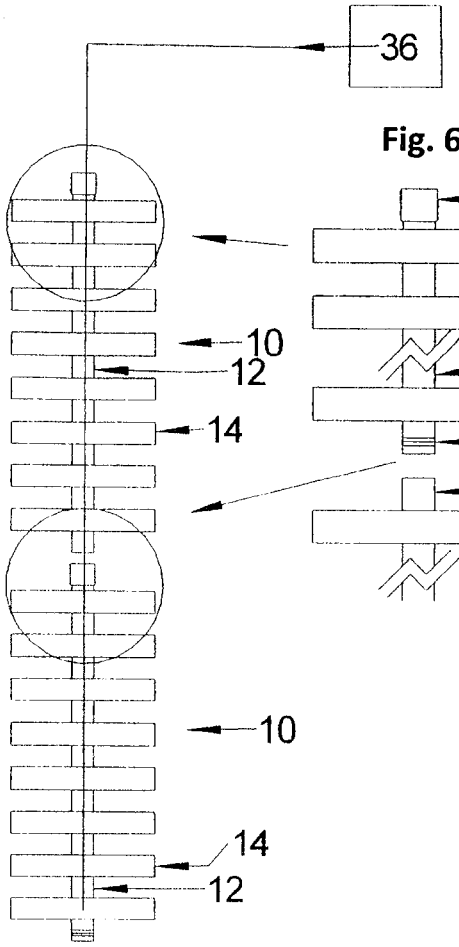
Fig. 6B
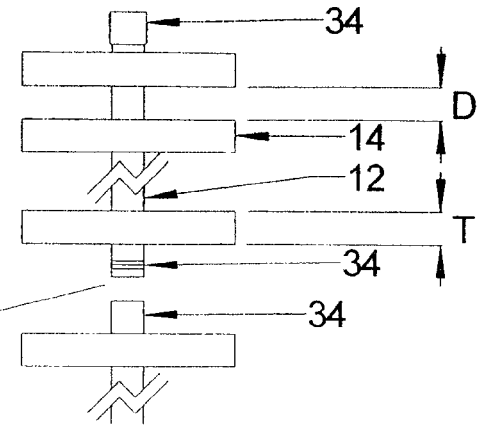
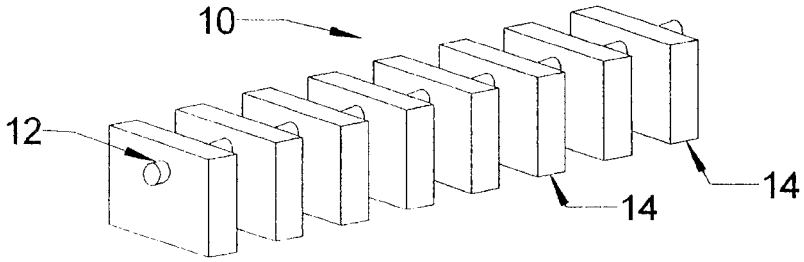
Fig. 7

ADAPTABLE MODULAR SUBSOIL DRAINAGE SYSTEM

CROSS REFERENCE TO RELATED APPLICATIONS

This application is a continuation-in-part of U.S. patent application Ser. No. 11/363,668 for "Subsoil Drainage System", filed Feb. 28, 2006, which claims the priority to U.S. Provisional Application No. 60/657,308, filed Feb. 28, 2005 and U.S. Provisional Application No. 60/741,502, filed Dec. 1, 2005, the content of each of which is incorporated herein by reference.

BACKGROUND OF THE DISCLOSURE

The present disclosure relates generally to the field of subsoil fluid absorption and drainage systems, and more particularly to a versatile system which includes a plurality of modules each defining a cavity or chamber and arranged spaced apart in series, typically in fluid communication.

Conventional subsoil fluid absorption systems are comprised of trenches or excavations filled with small rock aggregate and overlaid with a perforated pipe. The pipe may be overlaid with a geotextile fabric and/or more rock aggregate. Soil is placed over the aggregate and perforated pipe to fill the trench to the adjoining ground level. In use, fluid flows through the pipe and out the perforations. Fluid is held within cavities in the aggregate until it can be absorbed into the soil. Other conventional systems use hollow plastic chambers placed beneath ground level to hold fluid until the fluid can flow through slits or apertures in the chamber and can be absorbed into the soil.

Current subsoil based absorption system products are limited in their design configuration, lack system flexibility and installation adaptability. For example, vertical separation may require additional fill in order to maintain adequate separation to groundwater or restrictive layers. It is also difficult for conventional systems to provide the increased bottom area and/or sidewall area required in some designs. Engineers, absorption system designers and absorption system installers are often faced with the dilemma of making the currently available products work in a nonsuitable environment. Installation of the rock aggregate also entails moving tons of aggregate from a pile and evenly distributing the aggregate into the excavation. Such movement is time consuming, requires specialized equipment and tends to destroy large parts of the surrounding lawn areas, and is thus very costly.

SUMMARY

There is a need for a universal kit with valve assembly parts that are appropriate for installation into flush tanks with different sized discharge holes. The present disclosure is directed to a kit, an adapter cup and a method for installing a valve assembly using the kit components, whereby a single flush tank valve assembly can be installed into toilet tanks with different sized discharge holes.

According to a preferred embodiment, a subsoil absorption system is provided. The system includes a subsoil drainage unit positioned within an excavation. The drainage unit has a plurality of modules, each with a front face and an opposing rear face. The module front and rear faces have upper and lower edges and define an inner cavity therebetween. The opposing module faces each has an aperture and is fluid permeable. A support pipe defines a longitudinal direction is positioned within each of the module face apertures and extends through the inner cavity. Adjacent modules are in positions spaced from each other along the support pipe. Backfill is positioned within the space between adjacent modules. A source of fluid provides fluid to the inner cavity of at least one module, which is allowed to thereafter flow from the inner cavity into the backfill.

BRIEF DESCRIPTION OF THE DRAWINGS

Aspects of the preferred embodiment will be described in reference to the Drawing, where like numerals reflect like elements:

FIG. 6A is a different schematic top plan view of the system of FIG. 5;

FIG. 6B is an enlarged view of portions of the system depicted in FIG. 6A;

FIG. 7 is a perspective view of the systems shown in FIGS. 5-6B;

DETAILED DESCRIPTION OF THE PREFERRED EMBODIMENT

With reference to the Figures, disclosed is an embodiment of a modular subsoil drainage system featuring a plurality of individual self-supporting modules arranged in a spaced orientation and in fluid communication.

With reference to FIG. 7, a PME unit 10 is formed by combining a support pipe 12 with one or more support modules, each 14 so that the support modules 14 are attached to the support pipe 12.

Figure 4:
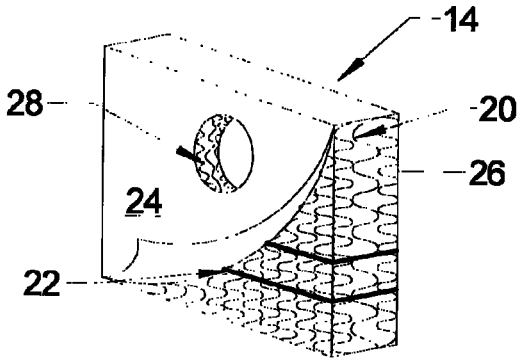
FIG. 4 is a schematic perspective view of an embodiment of support module for use in the disclosed system.

With reference to FIG. 4, each support module 14 is constructed of any suitable sheet material of various widths and lengths. Preferably the sheet material is a polymeric material. Recycled high impact polystyrene having a thickness of 0.24 inches has been found suitable for use as a module sheet 20. The module sheets 20 are configured into flat sheets and/or egg carton shaped cuspated core sheets. Cuspated sheets are described in U.S. Pat. No. 4,880,333 the contents of which are incorporated by reference. The cuspated core sheets, alone or in combination with flat sheets are aligned in face to face orientation and joined together, for example with bands 22, to form the support module 14. Commercially available plastic banding material has been found suitable for banding the aligned module sheets 20.

The support module 14 may be of any desired shape and are not limited to the exemplified square or rectangular shapes shown in FIG. 4. Module shape may be altered for various objectives such as allowing increased interfacial area between the module and the soil and improving flow of fluid from within the support module to the surrounding soil.

With reference again to FIG. 4, support module width between the exterior faces 24, 26 can also be varied to any desired dimension. An aperture 28 is provided in each sheet 20 of the support module 14. The aperture 28 is sized to receive the support pipe 12. An aperture position offset from the center of the module 10 is desirable; however the aperture 28 may be in any position relative to the module 10. Additional apertures of the same or different sizes may be provided in some or all of the sheets to accommodate additional support pipes or to increase fluid movement within the support module and through the support module sheets.

The support pipe 12 is typically a polymeric material, for example polyethylene (PE), polyvinyl chloride (PVC) or acrylonitrile-butadiene-styrene copolymer (ABS), although other materials compatible with the anticipated use may also be used. The support pipe 12 is sized appropriately to meet desired strength and fluid capacity needs. One preferred support pipe is ADS 3000© triple wall pipe available from Advanced Drainage Systems, Inc. of Hilliard, Ohio. The ADS 3000© pipe has increased stiffness and crush strength compared to other polymer pipes. In one embodiment shown in FIG. 7, the support pipe 12 is inserted through the apertures 28 of a plurality of support modules 14 to form a PME unit 10. The support pipe 12 can be solid or define one or more perforations, each 32, along some or all of its length. Advantageously, the perforations 32 coincide with the position of the support module 14 on the support pipe 12 to define a fluid path through the pipe 12 to the support module 14 as shown best in FIG. 8. The perforations and module spacing can be designed to allow fluid flow to any or all of the modules.

The PME unit is formed by placing the support pipe 12 within the apertures 28 of one, or advantageously, a plurality of support modules 14 so that the support modules 14 are spaced along, and supported by, the length of the support pipe 12.

Figure 8:
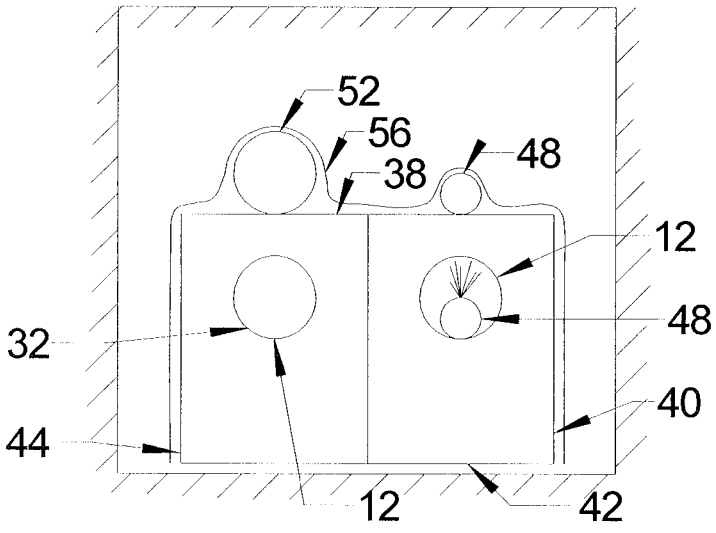
FIG. 8 is a schematic cross-sectional view of one embodiment of a PME unit in an excavation.

A subsoil fluid absorption and drainage system is formed by placing one or more PME units 10 in an excavation such as shown in FIG. 8. Multiple PME units may be fluidly connected by using conventional fittings 34 to attach support pipe 12 ends from adjoining PME units 10 as shown best in FIG. 6A. The terminal end of the support pipe may be capped with a conventional fitting 34 as shown best in FIG. 6B. After backfilling of the excavation edges, 38, 40, 42 and 44, of the module 14 are typically in contact with soil. The PME units 10 may be in a series or end to end arrangement as shown in FIG. 6A, in a parallel or side by side arrangement as shown in FIG. 8 or both. The support pipes 12 of PME units 10 arranged in series can be connected using standard pipe fittings and couplings if desired.

A fluid path is provided from a fluid source 36, shown in FIG. 6A, such as a septic system distribution box or a storm water runoff, through the support pipe 12 and to some of the support modules 14. Fluid in the support module 14 will flow between the module sheets 20 out through the edges of the support module 14 and into the surrounding soil. Since the support modules 14 are constructed of essentially parallel sheets 20 of material, the fluid path from the sheet 20 to the surrounding soil is almost completely unobstructed. A geotextile cover (not shown for clarity) may enclose some or all of the support module 14. The geotextile cover, if used, is fluid permeable and does not substantially obstruct fluid flow through from the module 14 to the soil. The unobstructed fluid path allows increased fluid flow through the PME unit 10 into the surrounding soil, providing a desirable improvement over conventional chambers that restrict fluid flow therethrough to slits, holes or other restrictive openings in an impermeable chamber wall. The space between adjacent sheets 20 in the support module 14 provides storage capacity for fluid until the fluid can be absorbed into the soil contacting the support module.

The PME unit may be used in a variety of subsoil fluid absorption and drainage systems. With reference to, for example, FIG. 8, in a pressure subsoil fluid absorption and drainage system, fluid from a source 36 can be pumped under pressure through a Low Pressure Pipe (LPP) 48 adjacent a support module 14. The support pipe 12 does not need to be directly connected to the fluid source in this embodiment. The low pressure pipe 48 can be positioned over the top of the modules 14 so that fluid flows from apertures 50 in the Low Pressure Pipe (LPP) 48 to the adjacent a support module 14. The low pressure pipe 48 can also be disposed within the support pipe 12 (LPP Low Invert) as shown in FIG. 8 so that fluid is discharged from apertures 50 in the Low Pressure Pipe (LPP) 48 into the support pipe 12 interior and through support pipe apertures 32 into the support module 14. Alternatively, the low pressure pipe 48 is not perforated and can be directly connected to a support pipe 12 (not shown). As used herein a direct connection can comprise conventional pipe fittings and sections of pipe between the low pressure pipe 48 and the support pipe 12 to control fluid flow from the low pressure pipe 48 to the support pipe 12. As used herein a direct connection does not encompass uncontrolled flow of fluid, for example, from a low pressure pipe aperture 50 through a support module 14 and to a support pipe 12.

With reference to, for example, FIG. 8, in a gravity subsoil fluid absorption and drainage system fluid flows by gravity from a source 36 through a gravity distribution pipe 52 to the adjacent support module 14. The support pipe 12 does not need to be directly connected to the fluid source in this embodiment. The gravity distribution pipe 52 can be positioned over the top of the modules 14 so that fluid flows from apertures 54 in the gravity distribution pipe 52 to the adjacent a support module 14. The support pipe 12 can also be fluidly connected to the fluid source 36 as (Gravity Low Invert) so that fluid flows by gravity into the support pipe interior and through the support pipe apertures into the support modules.

Alternatively, the gravity distribution pipe 52 is not perforated and can be directly connected to a support pipe 12 (not shown). The direct connection can comprise conventional pipe fittings and sections of pipe between the gravity distribution pipe 52 and the support pipe 12.

In one embodiment shown best in FIG. 8, the PME unit is placed in a previously prepared excavation so that the support pipe is generally parallel with the excavation floor and one side of the support modules contacts the excavation floor. Fluid is distributed by pressure or gravity from a source to some or all of the support modules.

In another embodiment (not shown) the PME unit is placed in a previously prepared excavation so that the support pipe is generally perpendicular with the excavation floor and the support module sides are adjacent the excavation sides. Fluid is distributed by pressure or gravity from a source to some or all of the support modules. This embodiment may be useful in drywell applications.

The subsoil fluid absorption system can have the PME unit 10 overcovered with geotextile fabric 56 as shown in FIG. 8. In this embodiment the fabric 56 keeps fill material from being placed between the support modules and the support module sheets so that a space or gap remains between the support modules. This gap provides substantial reservoir capacity to retain high volume fluid flows until the fluid can be absorbed into the adjacent soil. This gap also allows substantially unrestricted fluid transfer through the gap and between adjacent PME units.

In another embodiment (not shown) the faces, top and sides of the support module are wrapped in geotextile fabric. The support module bottom may be covered or may be left uncovered to contact the excavation floor and facilitate fluid transfer to the soil. Naturally, the fabric covering the support module faces would have apertures to allow the support pipe to be disposed within the support module. The fabric can be sewn into a formed cover and fitted over the support module. The cover, or separate fabric sections, can also be fastened to the support module by any other suitable method, for example by adhesive bonding, heat welding, stapling or banding.

If the fabric overcover exemplified in FIG. 8 is not used a fill material such as sand can be disposed in the gap between the support modules and over the interconnected PME units. In this embodiment the individually wrapped support module prevents fill material from being disposed between support module sheets 20. Fluid transfer between adjacent PME units will be somewhat restricted in this embodiment because of the fill material disposed in the gaps. In systems that comprise multiple PME units arranged in overlying or side by side configuration fluid transfer between adjacent, individually wrapped support modules can be increased by leaving the abutting edge of each adjacent module uncovered so fluid can be transferred from one uncovered edge to the abutting uncovered edge.

The exemplified PME units are linear. In other embodiments the support pipes of PME units can be connected with angle fittings to provide a nonlinear subsoil fluid absorption system comprising multiple PME units.

Having generally described the invention, the following examples are included for purposes of illustration so that the invention may be more readily understood and are in no way intended to limit the scope of the invention unless otherwise specifically indicated. It should be understood that the invention encompasses all possible configurations including, for example, modification to support module size and shape, support pipe size and configuration and PME unit size and configuration in addition to those exemplified below.

PME units were produced as described below. The material used for producing the exemplified PME units is shown in Table 1.

TABLE 1 module sheet 20 (Cuspated Core)

| Property | Test Method | Unit | Minimum Average Roll Value |
|---|---|---|---|
| Hl Polystyrene (raw) | Micrometer/Standard | 0.024" | 0.024" |
| Cuspated Core Height | ASTM D 1777 | 1.250" | 1.250" |
| Compressive Strength | ASTM D 1621 | lbs./sq.ft. | 6,900 |
| Flow Capacity | ASTM D 4716 | gpm/sq.ft. | 15 |

TABLE 1

Support Pipe 12 (ADS 3000 © Triple Wall)

| Property | Test Method | Unit | typical value |
|---|---|---|---|
| HD polyethylene | Standard | feet | 10 |
| diameter | Standard | inches | 4 |
| Stiffness | ASTM D 2412 | Psi | 22 |
| Perforations | Standard | Dia/inches | 0.625" |
| Perforation Spacing | Standard | Inches | 3.5 |
| Perforation Degrees | Standard | Degrees | 120 |

TABLE 1

Band 22

| Material | Width | Thickness |
|---|---|---|
| Polypropylene | 0.500" | 0.025" |

TABLE 1

Geotextile Cover Fabric 56

| Property | Test Method | Unit | Minimum Average Roll Value |
|---|---|---|---|
| Weight | ASTM D 5261 | oz/sq. yd | 5.0 |
| Grab Tensile | ASTM D 4632 | Lbs. | 130 |
| Grab Elongation | ASTM D 4632 | % | 50 |
| Trap Tear | ASTM D 4533 | Lbs. | 55 |
| Puncture | ASTM D 4833 | Lbs. | 75 |
| Mullen Burst | ASTM D 3786 | Psi | 265 |
| Permittivity | ASTM D 4491 | 1/sec | 1.7 |
| Water Flow | ASTM D 4491 | Gpm/sf.ft. | 115 |
| A.O.S. | ASTM D 4751 | U.S. sieve | 70 |
| U.V. Resistance after 150 hours | ASTM D 4355 | % strength retained. | 70 |

Figure 5:
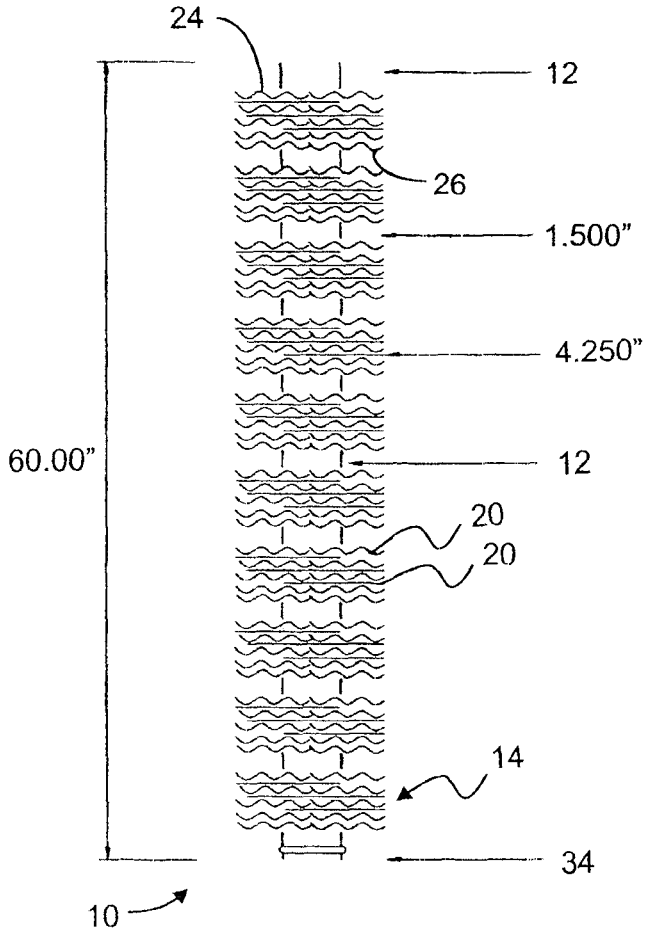
FIG. 5 is a schematic top plan view of an embodiment of the disclosed system, with modules defined by a plurality of generally parallel sheets.

In one embodiment shown in sheet FIG. 5 the PME unit 10 is 5 feet long. Each support module 14 is approximately 10 inches wide by 4.25 inches long by 12 inches to 14 inches high. Eight modules are spaced evenly along the 5-foot length of 4-inch diameter support pipe 12 with approximately a 1.5-inch gap between each module 14 and allowing 2 inches on either end of the support pipe 12 for placement of standard fittings.

Some additional PME unit 10 embodiments are listed in Table 2. Two PME units can provide up to 32 different installation configurations.

Table 2 Configuration Widths, Heights, Inverts, Pressure & Gravity

TABLE 2

Configuration Widths, Heights, Inverts, Pressure & Gravity

| Rows | Model | Width (Inches) | Height (Inches) | Length (Inches) | * LPP High Invert (Inches) | * LPP Low Invert (Inches) | ** Gravity Low Invert 4" Support pipe (Inches) | ** Gravity High Invert 4" Perforated pipe (Inches) |
|---|---|---|---|---|---|---|---|---|
| 1 | 1012-SV | 10 | 12 | 60 | 12 | 6 | 6 | 12 |
| 2 | 2012-DV | 20 | 12 | 60 | 12 | 6 | 6 | 12 |
| 3 | 1210-SH | 12 | 10 | 60 | 10 | 3 | 3 | 10 |
| 4 | 2410-DH | 24 | 10 | 60 | 10 | 3 | 3 | 10 |
| 5 | 1014-SV | 10 | 14 | 60 | 14 | 8 | 8 | 14 |
| 6 | 2014-DV | 20 | 14 | 60 | 14 | 8 | 8 | 14 |
| 7 | 1410-SH | 14 | 10 | 60 | 10 | 3 | 3 | 10 |
| 8 | 2810-DH | 28 | 10 | 60 | 10 | 3 | 3 | 10 |

* High Invert LPP - Place on top of support modules, see Installation Gudelines 10.2. Low Invert LPP - Install inside support pipe, see Installation Guidelines 10.4.
** High Invert Gravity - Install perforated distribution pipe on top of modules, see Installation Guidelines 10.6. Low Invert Gravity - Use perforated four-inch support pipe, see Installation Guidelines 10.8.

Table 3 Volume Capacity for Five-Foot PME Units

TABLE 3

Volume Capacity For Five-foot PME Units

| Rows | Model | Width (Inches) | Height (Inches) | Length (Inches) | * LPP High Invert (Inches) | * LPP Low Invert (Inches) | ** Gravity Low Invert 4" Support pipe (Inches) | ** Gravity High Invert 4" Perforated pipe (Inches) |
|---|---|---|---|---|---|---|---|---|
| 1 | 1012-SV | 10 | 12 | 60 | 30.6 | 16.0 | 16.0 | 30.6 |
| 2 | 2012-DV | 20 | 12 | 60 | 61.2 | 32.0 | 32.0 | 61.2 |
| 3 | 1210-SH | 12 | 10 | 60 | 30.6 | 9.4 | 9.4 | 30.6 |
| 4 | 2410-DH | 24 | 10 | 60 | 61.2 | 19.0 | 19.0 | 61.2 |
| 5 | 1014-SV | 10 | 14 | 60 | 36.0 | 31.2 | 31.2 | 36.0 |
| 6 | 2014-DV | 20 | 14 | 60 | 72.0 | 62.4 | 62.4 | 72.0 |
| 7 | 1410-SH | 14 | 10 | 60 | 36.0 | 11.0 | 11.0 | 36.0 |
| 8 | 2810-DH | 28 | 10 | 60 | 72.0 | 22.0 | 22.0 | 72.0 |

1012 Family, Some Alternative Embodiments

Figure 1:
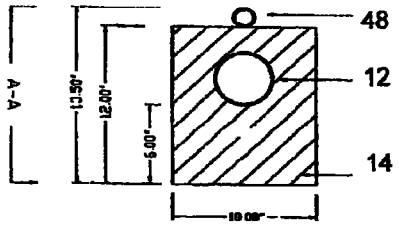
FIG. 1 is a schematic end view of one embodiment of the disclosed modular system with vertically oriented support modules.
Figure 2:
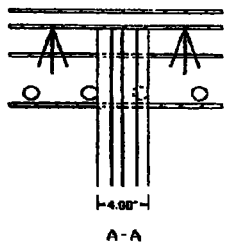
FIG. 2 is a schematic cross-sectional view of the system of FIG. 1.

The 1012-SV PME unit shown for example in FIGS. 1 and 7 comprises a plurality of modules 14 in spaced relationship along the length of a support pipe 12. The modules are in a vertical position with a width of ten inches and a height of twelve inches. The two LPP invert heights are based on either placing the low pressure pipe 48 on top of the support modules or within the support pipe 12. When the low pressure pipe 48 is placed on the support modules 14 it may be centered or offset to either side. The two gravity invert heights are based on either placing the gravity distribution pipe 52 on top of the support modules 14 or using the support pipe 12 to distribute the fluid (see for example FIG. 7). In a gravity system the gravity distribution pipe 52 for the high invert option may be offset to either side support modules 14. The support pipe apertures 32 are preferably at the 5:00 & 7:00 o'clock positions.

Figure 3:
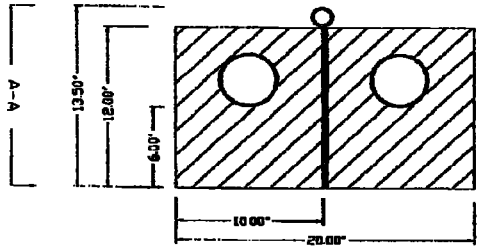
FIG. 3 is a schematic end view of another embodiment of a modular system.

The 2012-DV PME unit shown for example in FIG. 3 comprises a doubled side by side configuration of the 1012-SV embodiment. The modules are in a vertical position. The 2012-DV PME unit thereby doubles the bottom surface area width and void space as compared to the 1012 embodiment. The two LPP invert heights are based on either placing the low pressure pipe 48 on top of the support modules 14 or within one or both of the support pipes 12. When the low pressure pipe 48 is placed on the support modules 14 it may be centered or offset to either side. The two gravity invert heights are based on either placing the gravity distribution pipe 52 on top of the support modules 14 or using one or both of the support pipes 12 to distribute the fluid. In a gravity system the gravity distribution pipe 52 for the high invert option may be offset to either side support modules 14. The support pipe apertures 32 are preferably at the 5:00 & 7:00 o'clock positions.

Figure 9:
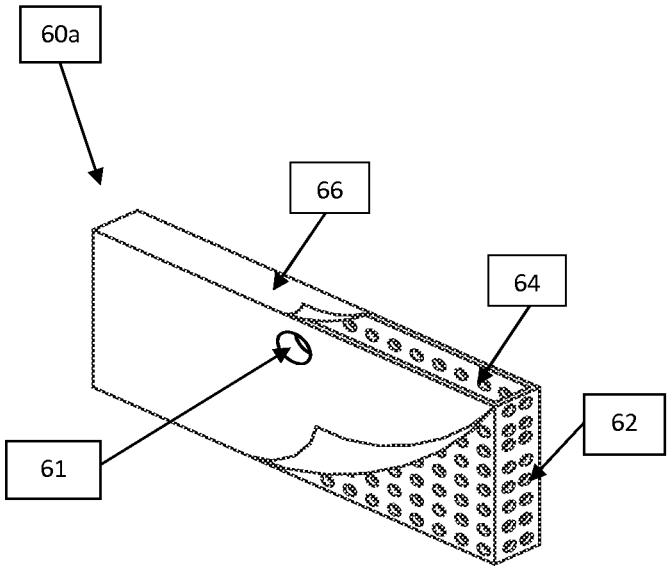
FIG. 9 is an alternative embodiment of a module for use within the disclosed subsoil drainage system.

Additional embodiments of the disclosed subsoil drainage system exist, which utilize modules spaced along a support pipe with different configurations than the embodiments disclosed above. Rather than cuspated (or non-cuspated) polymer sheets, modules within the system can comprise numerous other materials with similar high functionality. Notable qualities of modules desirable for incorporation into the disclosed system include, without limitation:

high durability and strength
light weight
self-contained
fluid permeable, generally non-absorbent material
compact
encourages drainage into surrounding environment/media
high ratio of surface area to length FIG. 9 illustrates an alternate embodiment of module 60*a* comprising a single outer layer of a polymeric sheet 62, or like material. The polymer sheet 62 is fit with numerous drainage orifices 64 to improve fluid drainage from the interior cavity or chamber of the module 60 into the exterior environment when in use. The dimensions of the module 60 can be altered, as necessary for a particular environment, channel or regulatory requirement. Similar to the embodiment of FIG. 4, a layer of fluid permeable fabric 66 can be employed to envelope the outer surface of the sheet 62 in whole or in part. The module 60*a* can comprise a single length of polymer sheet 62 arranged in the formation shown or multiple sheets attached together, for example, welded at the module corners. A preferred embodiment employs a sheet 62 made of a polymeric material, but additional inert and somewhat rigid materials could be employed to prepare a module like that depicted as reference numeral 60*a*.

Figure 11:
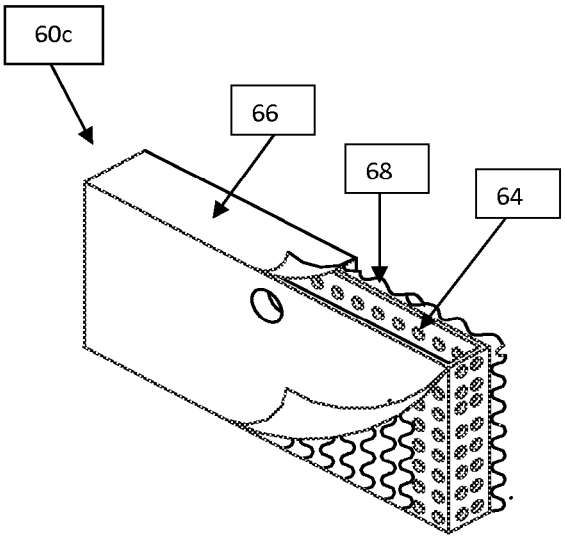
FIG. 11 is yet an alternative embodiment of a module for use within the disclosed subsoil drainage system.

FIG. 11 shows a module 60*c*, which is similar to that of FIG. 9 with a layer of cuspated polymer core sheet 68 (similar to sheets 14) positioned between the sheet 62 and fabric 66. This configuration can assist fluid flow from the interior cavity of the module to the external environment (typically absorbed into backfill media).

Figure 10:
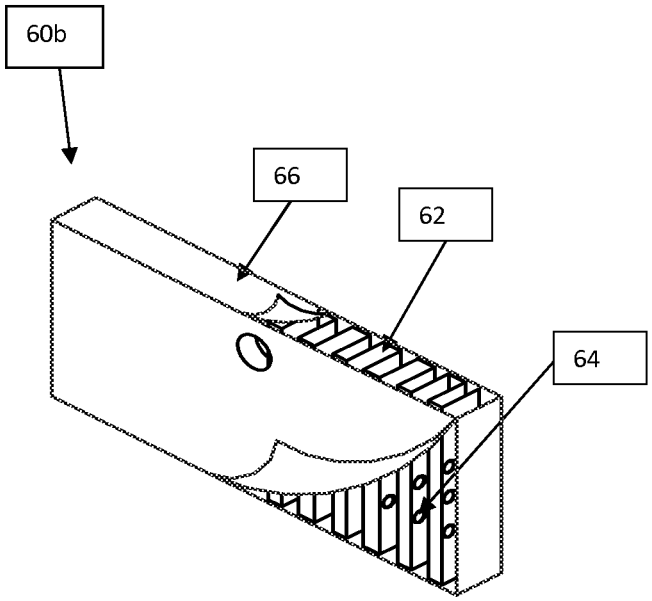
FIG. 10 is yet an alternative embodiment of a module for use within the disclosed subsoil drainage system.

With reference to FIG. 10, a single sheet 62 can also be arranged in a snake-like (or zig-zag) formation to construct a module 60*b*. Here, a vertically oriented sheet 62 with orifices 64 is folded to the desired length and width of the module. A fabric sheet 66 is again used to envelope and assist in retaining the shape of the module 60*b*. The sheet 62 is preferably of a material that is rigid and strong enough such that one or more modules can stand upright and self-supported with at least one support pipe conduit extending through the aperture 61. As should be clear from the Figures, the polymer sheets comprising modules 60*a*, 60*b* and 60*c* can be the same material.

Figure 12:
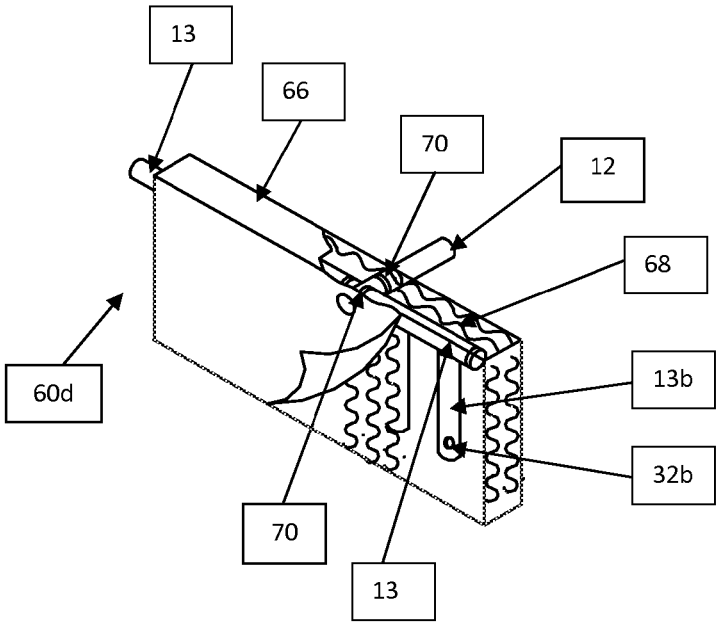
FIG. 12 is yet an alternative embodiment of a module for use within the disclosed subsoil drainage system.

FIG. 12 depicts an alternate embodiment of a fluid conduit configuration for use within the disclosed modular drainage system. Instead of a single support pipe 12 extending generally perpendicularly through upright modules (i.e., FIG. 7), a T-junction 70 is incorporated within the interior area of the module 60*d*. A cross conduit 13 is engaged with the T-junction 70 generally perpendicular to the support pipe 12 and can be fit with one or more vertically extending conduits 13*b*, optionally having drainage apertures 32*b*. The cross conduit 13 can be used to connect an additional fluid source to the subsoil drainage system or simply to improve fluid flow rate from a single source (for example, via support pipe 12). Inclusion of additional conduits such as those depicted as reference numerals 13 and 13*b* also improves fluid distribution within and out from a module such as 60*d*. The depicted module 60*d* comprises a plurality of core sheets 68 fit with appropriate bores to accommodate and support each pipe and conduit therein. The module 60*d* comprising parallel core sheets 68 can of course be replaced with any of the additional disclosed module embodiments (60*a*, 60*b*, 60*c*, 60*e*, 60*f*), provided appropriate bores or spaces are provided to accommodate additional fluid conduits 13 and 13*b*. Alternatively, connecting elements can be employed to aid in supporting and maintaining the cross conduit 13*a* (not depicted) in a desired position. Connecting elements can attach to a cross conduit 13 or vertical conduit 13*b* and secure them somewhat rigidly relative to the packing and/or front or rear module faces. Connecting elements are particularly useful within a module that is lightly packed or generally hollow.

Figure 13:
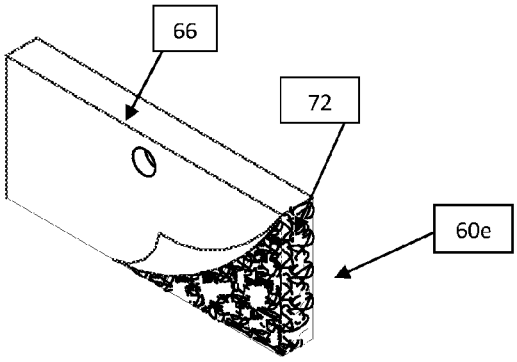
FIG. 13 is yet an alternative embodiment of a module for use within the disclosed subsoil drainage system.

FIG. 13 shows an embodiment of the module 60*e* which includes an inert mesh material 72 incorporated within the interior area of the module. The mesh material 72 can be enveloped by the fluid permeable fabric 66. Mesh material 72 can be incorporated within the additionally depicted module embodiments, like those of FIGS. 9-11, to provide improved support to the drainage system. A preferred embodiment of mesh 72 is simply a shredded polymer material, however other generally non-absorbent, shredding can be employed in place of or in combination with shredded polymer material. The density of filling can be varied as preferred to achieve different drainage rates or to accommodate different excavation environments.

Figure 14:
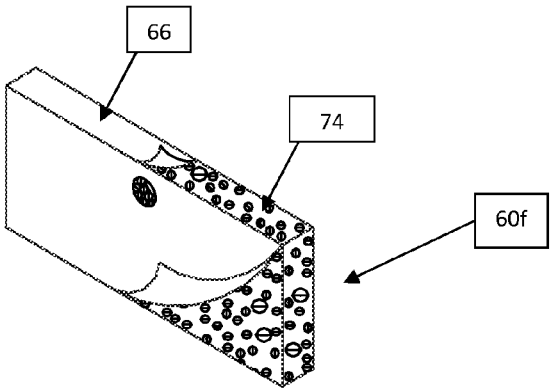
FIG. 14 is yet an alternative embodiment of a module for use within the disclosed subsoil drainage system.

FIG. 14 depicts an alternate module embodiment 60*f* that utilizes random inert packing 74. Particularly effective packing 74 is comprised of perforated generally hollow plastic balls, like Whiffle® balls, or other random pieces of polymer packing. Hollow perforated balls can optionally be individually enveloped in fluid permeable fabric. As with the FIG. 13 embodiment, the packing 74 can be included within the interior of the respective module to provide improved support characteristics.

Figure 15:
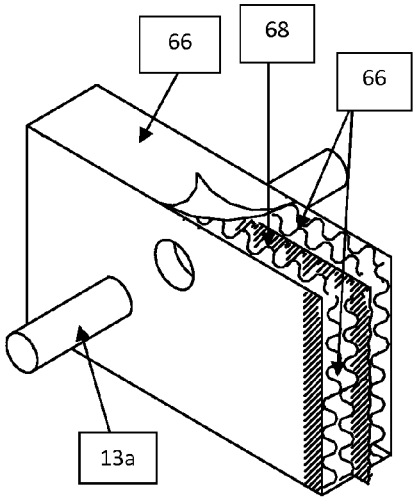
FIG. 15 is yet an alternative embodiment of a module for use within the disclosed subsoil drainage system, showing a unique embodiment of fluid conduit extending therethrough.

With reference to FIG. 15, modules like those disclosed therein can optionally include additional layer(s) of fluid permeable fabric 66 positioned between the front face 24 and rear face 26 to aid fluid flow control and filtration. As also depicted in FIG. 15, modules can be fit with additional apertures through which an additional conduit 13*a* can extend. The number and location(s) of additional conduits 13*a* depicted are non-limiting. The modular system disclosed herein is versatile and adaptable as needed to satisfy different fluid flow rates and source locations, as well as different drainage system regulatory requirements or ordinances.

Figure 16:
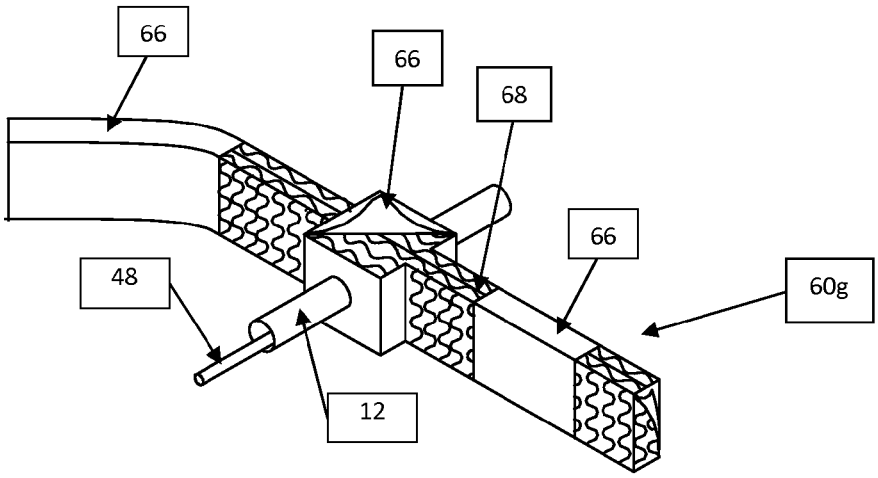
FIG. 16 is an alternative embodiment of the disclosed subsoil drainage system assembly.
Figure 17:
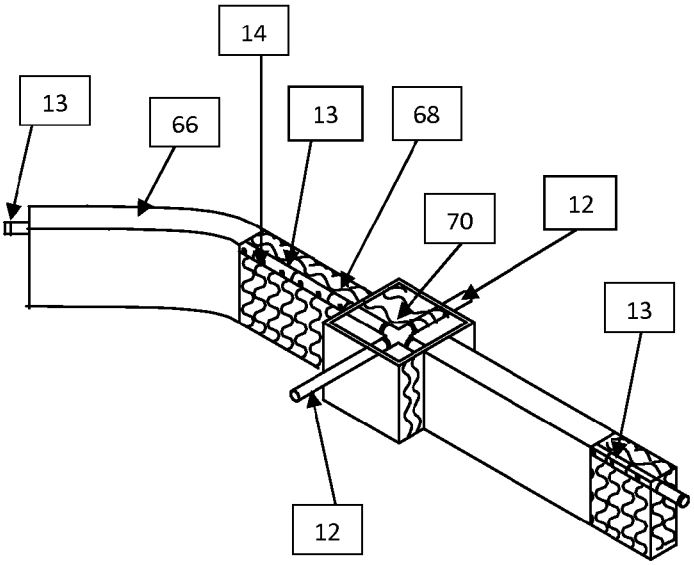
FIG. 17 shows an alternative conduit arrangement for use within the disclosed subsoil drainage system assembly.
Figure 18:
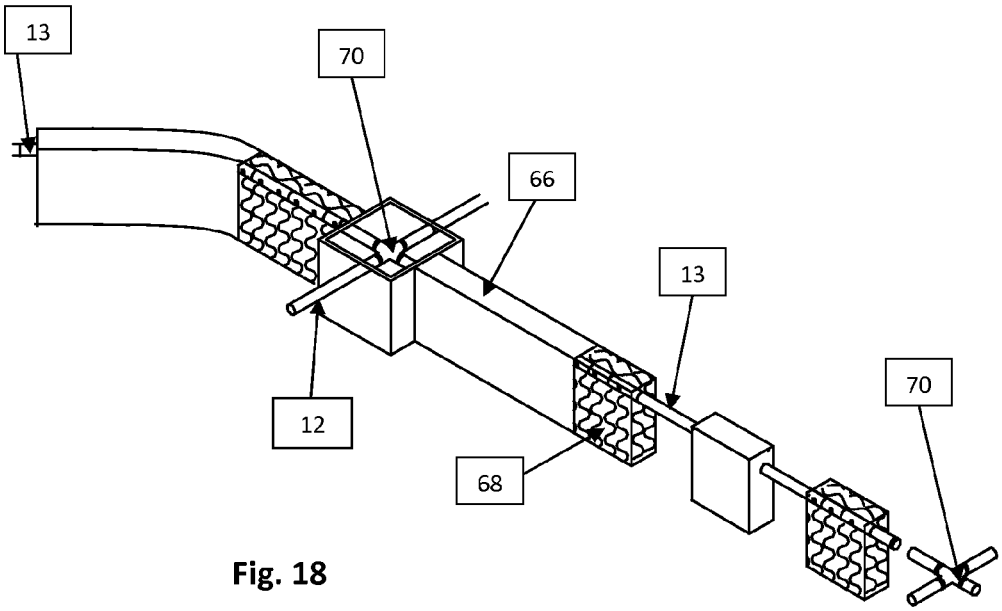
FIG. 18 shows an alternate modular arrangement for use within the disclosed subsoil drainage system assembly.

FIGS. 16-18 further display the versatile nature of the disclosed modular system. As shown in FIG. 16, the module 60*g* can extend virtually as long as practicable for a particular location or excavation. Additionally, the embodiments of modules disclosed herein can be laterally malleable to allow for optional bends while retaining strength and support properties. Also shown is a distribution pipe 48 positioned within the main support pipe conduit 12. The inner distribution pipe 48 can be used to deliver air flow to the system or simply as another fluid conduit. FIG. 17 shows a drainage system similar to that of FIG. 16, except that a T-joint 70 and associated cross conduits 12 and 13 are incorporated within the modules. FIG. 18 depicts another embodiment of the disclosed drainage system, expanded with additional modules spaced along the conduit 13.

Figure 19:
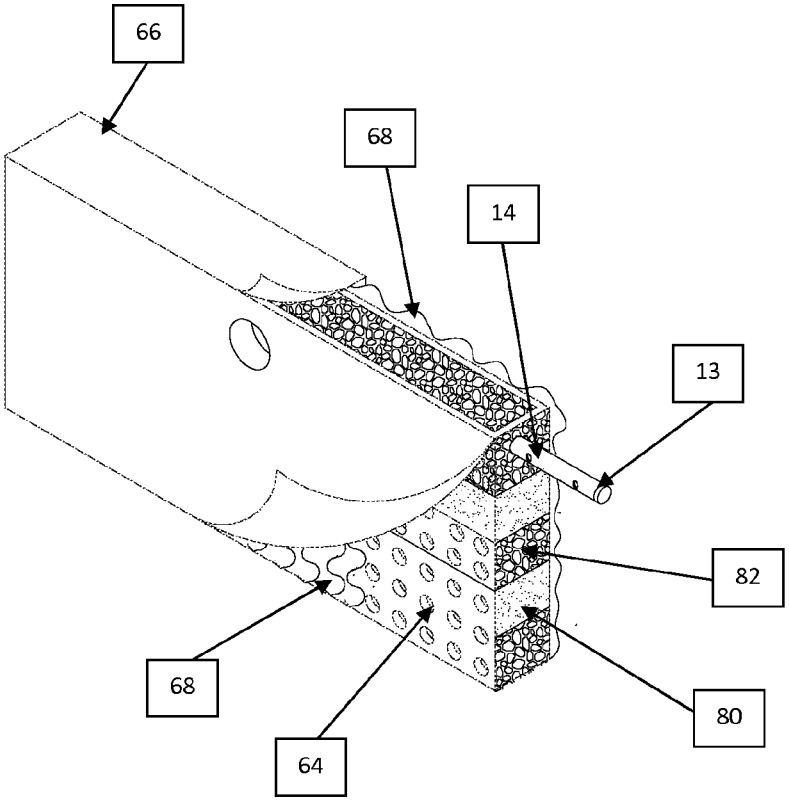
FIG. 19 is yet another embodiment of a module and fluid conduit arrangement for use within the disclosed subsoil drainage system.

FIG. 19 depicts an alternative module, with layered filtering media filler such as sand 80 and aggregate 82. The sand layer 80 can be substituted with any suitable porous filtering media. Likewise, the aggregate layer 82 can be substituted with another coarse inert material such as gravel or stone. The thickness and positioning of each layer, 80 and 82, can be varied as necessary for various filtration and drainage rate objectives.

Figure 20:
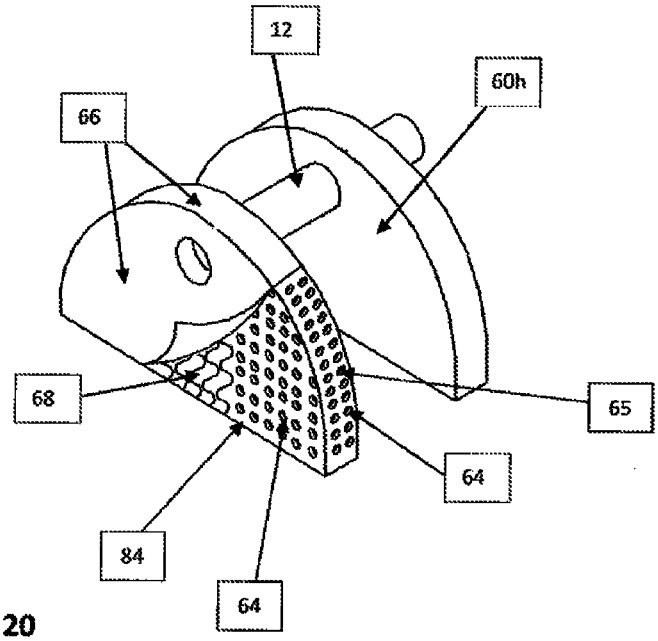
FIG. 20 is a depiction of a subsoil drainage system with alternate configured modules.

As shown with reference to FIG. 20, the modules disclosed herein are not limited in shape. FIG. 20 depicts modules 60*h* each with a generally flat elongated bottom 84 and an upper radial surface 86. These particular modules 60*h*, include a bottom 84 that is open to the media in the bottom of the excavation within which the system is installed. The orifices (65, 64) in the upper radial surface 86 and front and rear faces 24 and 26 assist in allowing fluid flow from the interior of the module to the excavation fill media. A notable aspect of this design is the orifices 65 in the upper surface 86 which also allow venting above the invert of the support pipe conduit 12, thereby encouraging evapotranspiration and evaporation. Like the previously disclosed embodiments, the modules 60*h* can include a cuspated layer 68 and/or fluid permeable fabric 66.

The disclosed modules are all generally self-supporting and self-contained, and comprise generally non-absorbent materials, while allowing fluid flow into the surrounding environment (backfill). As shown in numerous Figures, individual modules (14, 60*a*, 60*b*, 60*c* . . . ) are typically positioned spaced apart from each other along a length of a support pipe 12. The support pipe 12 preferably has a plurality of apertures 32 in its radial surface. One embodiment of the drainage system is configured with at least some of the support pipe apertures positioned within the interior area of modules (between the front face 24 and rear face 26), thereby fluidly connecting the respective interior areas of individual modules that are otherwise separated. Additional embodiments exist without the support pipe 12 providing a fluid path between module interior areas. For example, as shown in the embodiments depicted in FIGS. 1 and 3, a fluid conduit 48 can be positioned above the modules configured to deliver fluid to the modular system proximate the top edge of the modules, while the support pipe 12 is employed to physically connect spaced apart modules. Still, further embodiments can include one or more fluid conduits 48 positioned within a support pipe 12 for delivering fluid to the modular system. Appropriate fluid conduits 48 can be rigid (i.e., PVC pipe) or a flexible tube. Embodiments with a flexible fluid conduit 48 positioned within a support pipe 12 can also employ fasteners (not shown) positioned within the support pipe for securing the flexible fluid conduit 48 in a desired position. Flexible tube conduits can also be employed to deliver fluid to or from a module in virtually any direction, thereby improving versatility of the modular drainage system.

The distance that modules are separated from each other can be varied as required for particular objectives or conditions. Spacing between modules does not have to be uniform along the length of the support pipe, thus further improving the versatility of the drainage system. The spatial distance between adjacent module faces typically falls within 1.5-12 inches, but this range is non-limiting. Distance between adjacent module faces can be altered based on environmental conditions, such the type and/or density of media used to backfill the excavation and spaced area between modules. Similarly, thickness of individual modules can be varied.

A typical installation of the disclosed treatment system includes the sequential steps of:

1. Preparing an excavation, usually in a soil environment. The excavation should be sized and shaped to receive a modular unit. Of course, the size and configuration of the modular unit can also be varied as necessary to accommodate an excavation or environment.
2. Modular drainage units, including at least a plurality of modules and a support or fluid conduit pipe are placed within the excavation. Units can be assembled within the excavation or prior to placement therein. Adjacent support pipe pieces may be connected via appropriate connector and/or adhesive, depending on regulatory requirements if any. As indicated above, the plan layout of the modular system can be specified and configured as necessary for the particular environment with use of appropriate connectors.
3. In some embodiments, a fluid permeable fabric overcover may be employed, typically laid over the modular unit to improve subsoil breathability of the system.
4. The excavation is backfilled by hand shoveling or sloughing clean backfill material along the sides, between adjacent spaced modules and the top of the modular units. Backfill material can be clean and porous fill material, such as native soil, pearlite, septic fill, preferably devoid of large rocks. Appropriate seed may be laid over the excavated areas to protect against erosion and improve aesthetics.

The disclosed modular drainage system provides substantially greater interfacial surface area between individual modules and the surrounding media environment per linear foot of land compared to known systems. When installed, the sturdy, light weight, portable, durable and versatile modular units enable superior drainage and fluid treatment rates per unit area, less overall land disruption. The significantly improved performance of the modular drainage system disclosed herein ultimately results in significant time, cost and environmental savings, compared to known drainage systems.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A subsoil absorption system comprising:

an excavation;

a subsoil drainage unit positioned within the excavation, comprising a plurality of modules, each module comprising a front face and an opposing rear face each with upper and lower edges and defining an inner cavity therebetween, the front and rear faces of each module having an aperture and being fluid permeable;

a support pipe defining a longitudinal direction positioned within each front and rear face aperture extending through said cavity of each module, adjacent modules being positioned along the support pipe with longitudinal space therebetween;

backfill positioned within and filling the entire longitudinal space between adjacent modules; and a fluid source for providing fluid to the inner cavity of at least one module, wherein fluid provided to the at least one module inner cavity is allowed to flow from said inner cavity into the backfill, wherein said fluid source is fluidly connected to the support pipe, comprising at least one cross conduit positioned within the inner cavity of a module, extending generally perpendicular to the support pipe, and being fluidly connected to the support pipe and the inner cavity.

2. The subsoil absorption system of claim 1, wherein the support pipe comprises a radial wall defining a conduit that is fluidly connected to the inner cavity of at least one module.

3. The subsoil absorption system of claim 1, wherein the fluid source is connected to a secondary conduit that is configured to deliver fluid from the source to the inner cavity of at least one module.

4. The subsoil absorption system of claim 3, comprising a second aperture in each of the front and rear faces of the modules; wherein the secondary conduit is positioned within each of said second apertures extending through and fluidly connected to the inner cavity of the modules.

5. The subsoil absorption system of claim 3, wherein the upper edges of each module front and rear face define a module upper edge therebetween and the secondary conduit extends generally longitudinally above the upper edge of each module.

6. The subsoil absorption system of claim 3, wherein the secondary conduit comprises a flexible tube.

7. The subsoil absorption system of claim 6, wherein the secondary conduit is positioned within the support pipe.

8. The subsoil absorption system of claim 1, wherein the inner cavity of each module is filled with at least one of shredded polymer material, random plastic packing, plastic balls, sand, gravel, stone and cuspated polymer sheets.

9. The subsoil absorption system of claim 1, comprising a fluid permeable or semi-permeable fabric layer substantially enveloping each module.

10. The subsoil absorption system of claim 1, wherein each of the front and rear faces of each module is defined by a sheet having a plurality of apertures therein.

11. The subsoil absorption system of claim 1, wherein the modules each comprise a polymer sheet arranged in a snake-like configuration extending generally laterally from a first edge to an opposite second edge.

12. The subsoil absorption system of claim 1, comprising at least one sheet of fluid permeable fabric positioned between and generally parallel to the front and rear faces of at least one module.

13. The subsoil absorption system of claim 1, wherein at least one module is filled with at least two materials selected from the group consisting of shredded polymer material, random plastic packing, plastic balls, sand, gravel, stone and cuspated polymer sheets, arranged in a layered configuration.

14. The subsoil absorption system of claim 1, comprising an upper radial edge extending between the front and rear faces of a module, the upper radial edge defining a plurality of apertures.

15. The subsoil absorption system of claim 1, comprising a fluid conduit fluidly connected to the fluid source, the fluid conduit disposed in fluid communication with the support pipe.

16. The subsoil absorption system of claim 1 wherein at least a portion of the cross conduit includes a lateral bend and the module within which the cross conduit is positioned is laterally malleable, thereby accommodating the bend in the cross conduit.

17. The subsoil absorption system of claim 1, comprising an additional side module positioned along the cross conduit spaced laterally from the module through which the support pipe extends.

18. The subsoil absorption system of claim 1, wherein the inner cavity of at least one of the plurality of modules is filled with at least one layer of aggregate abutting at least one layer of porous filtering media.

19. The subsoil absorption system of claim 1, wherein at least one module is defined by a single sheet of polymer arranged in a snake-like formation extending laterally.

20. The subsoil absorption system of claim 1, comprising a secondary conduit positioned within the support pipe, the secondary conduit being connected to an air source for delivering air flow to the system.

* * * * *